United States Patent [19]

Imai et al.

[11] Patent Number: 4,554,234

[45] Date of Patent: Nov. 19, 1985

[54] TONER APPLICATION METHOD AND COMPOSITION THEREFOR

[75] Inventors: Eiichi Imai, Narashino; Masanori Takenouchi, Urawa; Masaki Uchiyama, Nakamachi; Koshi Suematsu, Kawasaki, all of Japan

[73] Assignee: Canon Kabushiki Kaisha, Tokyo, Japan

[21] Appl. No.: 658,788

[22] Filed: Oct. 9, 1984

[30] Foreign Application Priority Data

Oct. 19, 1983 [JP] Japan ..... 58-195606

[51] Int. Cl.[3] ..... G03G 13/09; G03G 13/08

[52] U.S. Cl. ..... 430/122; 430/102; 118/658; 222/403; 222/423; 222/DIG. 1; 427/25; 427/27

[58] Field of Search ..... 430/102, 122; 118/658; 427/25, 27; 222/403, 423, DIG. 1

[56] References Cited

U.S. PATENT DOCUMENTS 4,337,724 7/1982 Hosono et al. ..... 118/658 X
4,365,586 12/1982 Hosono et al. ..... 118/658 X
4,385,829 5/1983 Nakahata et al. ..... 430/122 X

FOREIGN PATENT DOCUMENTS 56-69669 6/1981 Japan ..... 430/122
57-99670 6/1982 Japan ..... 118/658

*Primary Examiner*—Roland E. Martin
*Attorney, Agent, or Firm*—Fitzpatrick, Cella, Harper & Scinto

[57] ABSTRACT

A thin layer of triboelectrically charged toner for developing an electrostatic latent image is formed by forming a magnetic brush of magnetic particles in a container containing the toner and the magnetic particles, and circulating the magnetic brush in the container on a toner carrying member. In this case, a uniform layer of toner adapted for development is obtained, if the magnetic particles have specific shape characteristics such that, where each magnetic particle is assumed to be circumscribed with a rectangular parallelopiped having edge length of a, b and c satisfying $a \geqq b \geqq c$ with the proviso that all of a, b and c are not the same, the average of b/a is from 0.4 to 1.0 and the average of c/a is from 0.4 to 0.95.

9 Claims, 3 Drawing Figures

TONER APPLICATION METHOD AND COMPOSITION THEREFOR

BACKGROUND OF THE INVENTION

This invention relates to a toner application method for developing electrostatic latent images with a toner and a composition therefor.

Conventionally, various types of apparatus have been proposed and put into practice as a dry type one-component developer apparatus. However, in any of those types, it has been very difficult to form a thin layer of one-component dry developer, so that a relatively thick layer of the developer is used. On the other hand, the recent desire for the improved sharpness, resolution or other qualities of developed images has necessitated the achievement of a system for forming a thin layer of one-component dry developer.

A method of forming a thin layer of one-component dry developer has been proposed in Japanese Laid-Open patent application No. 43037/1979 and has been put into practical use. However, this method is directed to the formation of a thin layer of a magnetic developer, not of a non-magnetic developer. The particles of a magnetic developer must each contain a magnetic material in a large proportion to gain a magnetic property. This is disadvantageous since it results in poor image fixing characteristic when the developed image is heat-fixed on a recording paper to be transfer-printed. Further, because the magnetic material is generally black or dark-brown in color, it is difficult to obtain a clear color image by using a megnetic toner.

For this reason, there have been proposed methods for forming a thin layer of non-magnetic developer such as a method wherein a developer is applied by attaching it to a cylindrical brush made of soft hair such as that of a beaver, and a method wherein a developer is applied onto a developing roller, the surface of which is made of fiber such as velvet by means of an application means such as a doctor blade. However, when a fiber brush is used in combination with an elastic blade, it is possible to control the amount of the developer, but uniform application is not effected. Moreover, only the fiber brush on the developing roller is rubbed and triboelectric charge is not imparted to the developer present between fibers of the brush, whereby a defect such as ghost is liable to occur. Further, because a non-magnetic developer is used, it is difficult to prevent the leakage of the developer out of the apparatus.

SUMMARY OF THE INVENTION

A principal object of the present invention is to provide a novel toner application method for obviating the above mentioned difficulties encountered in the conventional methods wherein a toner is applied to form a uniform thin layer on the surface of a toner carrying member, while being provided with a sufficient triboelectric charge.

A further object of the present invention is to prevent a toner from leaking out of a developing apparatus by providing a toner with an appropriate amount of triboelectric charge.

These and other objects of the present invention are accomplished by a method for applying a toner comprising:

forming, in a container containing a toner and magnetic particles for application of the toner, a magnetic brush of the magnetic particles;

circulating the magnetic particles in the container; and forming a thin layer of the toner electrically charged on the toner carrying member, wherein the magnetic particles have such shape characteristics that, where each magnetic particle is assumed to be circumscribed with a rectangular parallelepiped having edge lengths of a, b and c satisfying $a \geqq b \geqq c$ with the proviso that all of a, b and c are not the same, the average of b/a is from 0.4 to 1.0 and the average of c/a is from 0.4 to 0.95.

According to another aspect of the present invention, there is provided a composition comprising a toner and magnetic particles, wherein the magnetic particles have such shape characteristics that, where each magnetic particle is assumed to be circumscribed with a rectangular parallelepiped having edge lengths of a, b and c satisfying $a \geqq b \geqq c$ with the proviso that all of a, b and c are not the same, the average of b/a is from 0.4 to 1.0 and the average of c/a is from 0.4 to 0.95.

DETAILED DESCRIPTION OF THE INVENTION

In practicing the present invention, there is used an image bearing member, which may be a member in the form of a drum or a belt having a layer of a photosensitive material and a layer of an insulating material. A rotating or circulating toner carrying member is further used. The toner carrying member may be in the form of a cylindrical sleeve or an endless belt made of a non-magnetic metal such as aluminum, copper, stainless steel or brass or a synthetic resin. The surface of the toner carrying member may be roughened or provided with unevenness pattern in order to improve the toner conveying performance or to enhance the triboelectrification characteristic. Inside the toner carrying member or on the opposite side of the toner carrying member with respect to the image bearing member, a magnet for forming a magnetic brush may be disposed. The magnet may be in the form of a roller or cylinder wherein a plurality of magnetic poles of the same or opposite polarities are formed along the extending direction of the roller or cylinder, or an assembly of plural bar-shaped magnets affixed onto a fixed supporting member. A regulating member may be provided as desired at the outlet of a developer container. The regulating member may be a blade or plate or a wall made of a magnetic material such as iron or a nonmagnetic material such as aluminum, copper or a resin.

The present invention will be explained hereinbelow by referring to the accompanying drawings.

Figure 1:
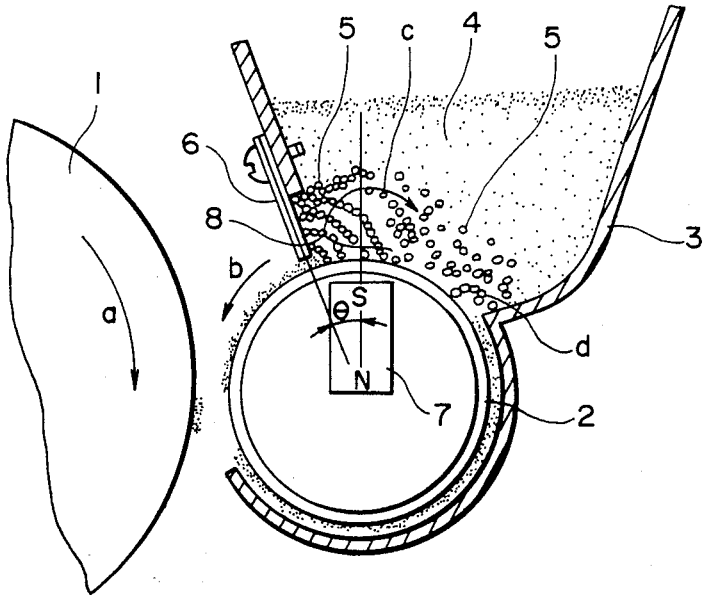
FIG. 1 shows a partial and schematic sectional view illustrating a developing apparatus for use in practicing the toner application method of the present invention.

FIG. 1 shows the cross-section of a developing apparatus to illustrate the principle of the development operation using the toner application method according to the present invention. The apparatus comprises an electrophotographic photosensitive drum 1 as a latent image bearing member which bears a latent image formed by an unshown latent image forming means. It is rotatable in the direction shown by arrow a passing through a developing station, where a non-magnetic sleeve 2, as a toner carrier for carrying a toner, is faced to the image bearing member with a predetermined gap or clearance. The sleeve 2 rotates in the direction shown by arrow b. Above the sleeve 2 is provided a container 3, made of a non-magnetic material such as resin or aluminum, for containing a mixture of a toner 4 and magnetic particles 5. The container 3 has, at its downstream side with respect to movement of the sleeve 2, a magnetic blade 6 screwed to the container 3 as a means for regulating the supply of the toner to the developing station.

Across the sleeve 2 with respect to the magnetic blade 6 and inside the sleeve 2, a magnet 7 is provided. The position of the magnet 7 is determined in connection with the position of a magnetic pole S thereof and the position of the magnetic blade 6, and practically, the pole S is preferably positioned slightly upstream of the position of the magnetic blade 6. This arrangement provides better prevention of magnetic particle leakage through the clearance between the magnetic blade 6 and the sleeve 2 surface and better application of the toner onto the sleeve 2 surface.

In the above arrangement, the magnetic particles within the container 3 forms a magnetic brush by the magnetic field formed between the magnetic pole S of the magnet 7 and the magnetic blade 6. Upon rotation of the sleeve 2, magnetic particles and toner are mixed and stirred, while the magnetic brush 8 is kept formed. In the neighborhood of the magnetic blade 6, the mixture of toner and magnetic particles except for the portion of the toner passing through the magnetic blade 6 carried on the sleeve 2 is stopped by the magnetic blade 6 so that the mixture moves upwardly and circulates as shown by arrow c.

The toner is charged triboelectrically by the friction with the magnetic particles. The charged toner is uniformly applied onto the sleeve 2 by the image force as a thin layer of non-magnetic developer and conveyed to approach the photosensitive drum 1.

The magnetic particles constituting the magnetic brush 8 is prevented from going out through the clearance between the magnetic blade and the sleeve 2, by setting the confining force of the magnetic field by the magnet 7 to be larger than conveying force caused by the friction between the sleeve 2 and the magnetic particles. And, when the magnetic brush-forming region contains toner, the content of the toner in this brush region is maintained constant by the rotation of the sleeve 2. Herein, the magnetic-brush forming region is defined as a region containing and enveloping the magnetic particles which are circulating under the constraint of the magnetic field in the container. Even when the toner is consumed by development, it is automatically compensated by the toner supplied to the region of the magnetic brush 8 due to the circulation of the magnetic brush. Thus, a constant amount of the toner is always applied onto the sleeve 2.

The magnetic particles as a carrier material in the conventional two component developer wherein the magnetic particles are used in a much larger proportion than a toner, are required as a principal function to triboelectrically charge the toner and control the amount of the charge. On the contrary, the magnetic particles of the present invention are required to fulfil functions of forming a magnetic brush in a region where the toner is present in a much larger proportion than in the two component developer, applying the toner on the toner carrying member and regulating the amount thereof. The magnetic particles are further required to fulfill a function of supplying the toner while circulating. Furthermore, it is not desirable that the magnetic particles pass by the regulating member. In order to fulfil these functions, the magnetic particles must show an appropriate circulatability while being confined by a confining force exerted by a magnetic field and form a magnetic brush having appropriate hardness and density so as to allow uniform application of the toner. A relatively sparse magnetic brush is liable to result in streaks of excessive and scarse toner on the toner carrying member due to insufficient regulation. On the contrary, a dense magnetic brush is liable to give an extremely thin coating layer on the toner carrying member. Either case is not desirable. Further, when the magnetic particles show an excessive circulatability, too thick a coating layer is formed to cause fog on the resultant image. On the other hand, when they show insufficient circulatability, several defects are encountered such as occurrence of ghost.

As a result of our studies for obtaining magnetic particles satisfying the above mentioned several requirements, we have obtained a knowledge that the shape or configuration of the magnetic particles, in addition to the particle size and its distribution of the magnetic particles, greatly affects the performance thereof.

More specifically, if the shape of the magnetic particles is a complete sphere, the circulating speed of the magnetic brush becomes too large or the function of regulating the application amount of a toner becomes insufficient, whereby a defect such as fogging occurs. On the contrary, if the shape is flat and thin like a plate, the circulation of the magnetic brush becomes poor or the force of regulating the toner application amount becomes too large, whereby problems such as partial decrease in image density or, in some cases, partial drop-off of images occur. Accordingly, the magnetic particles should have an intermediate shape between a complete sphere and a thin flat.

In the present invention, this intermediate shape is defined in the following manner.

Figure 3:
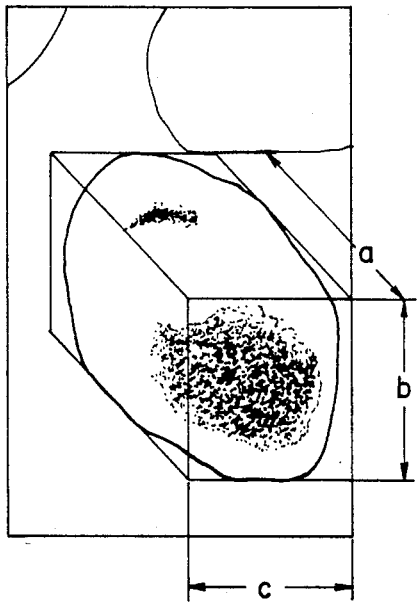
FIG. 3 is a schematic perspective view illustrating a bypothetical rectangular parallelepiped circumscribing a magnetic particle.

An individual particle among sample magnetic particle on a sample stand is photographed through an SEM (scanning electron microscope). At this time, several photographs are taken for the same particle including one taken under the condition where the electron beam is irradiated at right angles to the sample stand and one where the electron beam is irradiated in a direction close to the horizontal of the sample stand within a possible extent. Based on these photographs, a rectangular parallelepiped having edge lengths of a, b and c in mutually orthogonal three directions and circumscribing a particular magnetic particle is depicted on an appropriate photograph, wherein the a, b and c are arranged to satisfy the relationship of $a \geqq b \geqq c$ (see FIG. 3 for illustration). The values a, b and c are then measured.

The above procedure is repeated for at least 20 magnetic particles, and the averages of b/a and c/a are respectively calculated.

In the present invention, the magnetic particles should have an average of b/a of 0.4 to 1.0 and an average of c/a of 0.4 to 0.95, and preferably have a b/a of 0.5 to 1.0 and a c/a of 0.5 to 0.9 on averages. The magnetic particles to be used in the invention are preferably in the shape of, for example, potatoes as far as the above conditions are satisfied.

The magnetic particles for toner application of the present invention may, for example, be surface-oxidized or non-oxidized particles of a metal such as iron, nickel, cobalt, manganese, chromium or a rare earth metal, or an alloy of these, or particles of an oxide of these metals. These magnetic particles may be treated with a resin or another appropriate treating agent. In this case, the thickness of the resin or another treating agent should preferably be not larger than 1 micron. No particular restriction is posed on the processes for production of the magnetic particles. The magnetic particles may preferably have an average particle size of 50 to 200 microns and a particle size distribution where 50 wt. % or more, particularly 70 wt. % or more, of the particles are in the range of 50 to 200 microns.

On the other hand, the toner to be used in the present invention may comprise a binder resin of, for example, homopolymers of sytrene and derivatives thereof such as polystyrene, poly-p-chlorostyrene, polyvinyltoluene, and the like; styrene copolymers such as styrene-propylene copolymer, styrene-vinyl-toluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ether copolymer, styrene-vinyl ethyl ether copolymer, styrene-vinyl ethyl ketone copolymer, styrene-butadiene copolymer, styrene-isoprene copolymer, styrene-acrylonitrile-indene copolymer, styrene-maleic acid copolymer, styrene-maleic acid ester copolymer, and the like; polymethyl methacrylate, polybutyl methacrylate, polyvinyl chloride, polyvinyl acetate, polyethylene, polypropylene, polyesters, polyurethanes, polyamides, epoxy resins, polyvinyl butyral, polyacrylic acid resin, rosin, modified rosins, terpene resin, phenol resins, aliphatic or alycyclic hydrocarbon resins, aromatic petroleum resin, chlorinated paraffin, paraffin wax, etc. These binder resins may be used either singly or as a mixture.

As the colorant to be used in the toner, pigments or dyes known in the art such as carbon black, iron black, Phthalocyanine Blue, ultramarine, quinacridone, or Benzidine Yellow may be employed.

It is also possible to add, as a charge controlling agent, an amino compound, a quarternary ammonium compound or an organic dye, particularly a basic dye or its salt such as benzyldimethyl-hexadecyl ammonium chloride, decyl-trimethylammonium chloride, nigrosin base, nigrosine hydrochloride, Safranine γ, or Crystal Violet, a metal-containing dye, salicylic acid metal-containing compound, etc. Further, it is possible to add magnetic powder within such an extent that the effect of the invention is not hindered.

The above mentioned composition of the toner may be applicable to an ordinary developer obtained through the mixing-crushing method, or to either one or both of the wall material and core material of a microapsule toner.

The toner should preferably have a volume-average particle size of 5 to 20 microns, particularly 10 to 17 microns, as a value measured by a Coulter counter with an aperture tube of 100 microns in diameter.

The above mentioned toner and the magnetic particles should preferably be present in a weight ratio of 5:95 to 50:50, particularly 7:93 to 15:85 in the magnetic brush forming region.

Similarly the developer composition of the present invention should preferably comprise the toner and the magnetic particles in a weight ratio of 5:95 to 50:50, particularly 7:93 to 15:85.

The toner application method of the present invention is preferably applied to a developing method wherein the thus formed layer of toner is caused to jump onto an image bearing member to develop the image on the image bearing member. In this case, the image bearing member is disposed to face the toner carrying member with a gap or clearance therebetween wider than the thickness of the applied toner layer formed on the toner carrying member.

The present invention will be described in further detail by referring to actual examples of practice. In the examples, parts are by weight.

EXAMPLE 1

Figure 2:
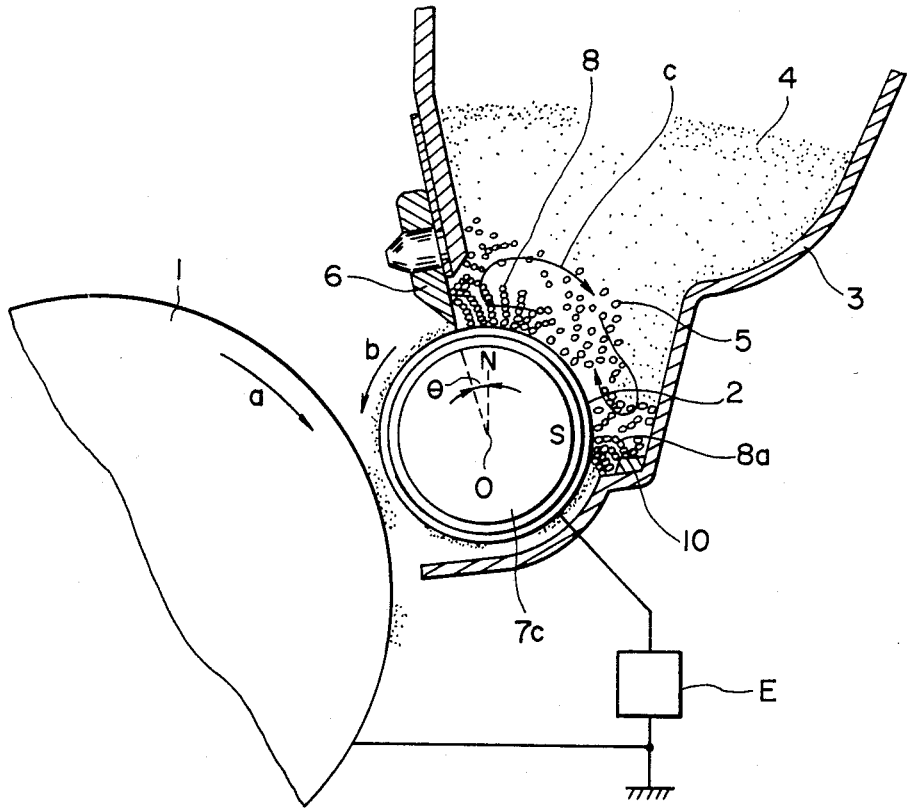
FIG. 2 shows a partial and schematic sectional view illustrating a developing apparatus used in actual examples of practice of the toner application method of the present invention.

The method of the present invention was practiced by using a developing apparatus as shown in FIG. 2. In FIG. 2, the same reference numerals denote substantially the same members as illustrated in FIG. 1.

In the apparatus shown in FIG. 2, a photosensitive drum 1 rotated at a peripheral speed of 60 mm/sec in the direction of arrow a. A sleeve 2 made of stainless steel (SUS 304) having an outer diameter of 32 mm and a thickness of 0.8 mm rotated in the direction of arrow b at a peripheral speed of 66 mm/sec. The surface of the sleeve 2 had been subjected to irregular shape sand blasting with alundum abrasive particles of 600 mesh pass and caused to have a roughness in the circumferential direction (Rz) of 0.8 micron. Inside the sleeve 2 was disposed a magnet 7*c* of a sintered ferrite type of which the first N pole was deviated toward inside of the container 3 by an angle ($\theta$ in the Figure) of 30° with respect to the line converting the tip of the magnetic blade 6 and the center of the sleeve 2.

The magnetic blade 6 was made of iron and the surface thereof was plated with nickel for prevention of staining. This blade 6 was disposed with a gap of 200 microns from the surface of the sleeve 2.

As the magnetic particles 5 were used sponge iron powder of 70 to 100 microns in particle size. The magnetic particles were found to have an average of b/a of 0.69 and an average of c/a of 0.64 through observation using a scanning electron microscope. The toner 4 was provided as a cyan-colored negatively chargeable powder of 12 microns in average particle size obtained by mixing 100 parts of a polyester resin (M.W.: about 40,000, Softening point: 150 ° C.), 10 parts of a copper phtharocyanine pigment (C.I. Pigment Blue 15) and 5 parts of a negative charge controlling agent (di-tertiarybutylsalicylic acid chromium complex), to which 0.5% of silica was externally added and mixed. The toner in an amount of 5 parts was well mixed with 50 parts of the magnetic particles and the mixture was charged into the container 3. Above the mixture was further added 200 parts of the toner. The circulation of the mixture of the toner and the magnetic particles in the container 3 was observed especially when the amount of the toner decreased.

In the above arrangement of developing apparatus, a layer of only the toner with about 40 microns-thickness was formed along with the rotation of the sleeve. The toner layer was subjected to the measurement of charged level by the blow-off method and found to be uniformly charged at the level of $-7.8$ μc/g.

On a photosensitive drum 1 facing the sleeve 2 with a gap of 300 microns was formed a charge pattern with a dark part of $+600$ V and a bright part of $+150$ V. To the sleeve was applied an alternating voltage in a frequency of 800 Hz and with a peak-to-peak value of 1.4 kV and a central value of $+300$ V, whereby clear blue images of high quality were obtained without development irregularity, ghost image or fogging.

With respect to the mixture in the container 3, the magnetic particles were substantially not dissipated but the toner was selectively consumed. The developing function was stable without charge until most of the toner was consumed. After the toner was consumed, the development apparatus was taken out from the entire system and the lower part of the sleeve 2 was inspected, whereby no leakage of the magnetic particles nor even of the toner was observed.

EXAMPLE 2

The procedure of Example 1 was repeated with some modifications.

The gap between the blade 6 and the sleeve 2 was set at 100 microns. The magnetic particles comprised iron powder having an average b/a value of 0.84 and an average c/a value of 0.71 and surface-treated with polyvinylidene fluoride. The toner 4 comprised powder of a mixture of 100 parts of a styrene-acrylic resin (copolymerization ratio: 70:30, M.W.: about 50,000), 10 parts of an azo pigment (C.I. Pigment Red 57) and 5 parts of an aminoacrylic resin (M.W.: about 20,000, Softening point: 100 ° C.), and 0.5 part of colloidal silica externally added and mixed therewith. An organic photoconductor was used to form the photosensitive drum 1.

With the above modifications, the procedure of Example 1 was repeated, whereby the magnetic particles circulated properly to form a thin layer of only the toner on the surface of sleeve 2. By using this thin layer of toner, an electrostatic image on the photosensitive drum was developed, whereby an extremely good red developed image was obtained. The above developing operation was stable without change until most of the toner was consumed, with no occurrence of leakage of toner or magnetic particles to below the sleeve 2.

EXAMPLE 3

Example 2 was similarly repeated except that the gap between the blade 6 and the sleeve 2 was set at 250 microns and ferrite particles having an average b/a of 0.93 and an average c/a of 0.89 were used as the magnetic particles 5, whereby good results were obtained.

EXAMPLE 4

Example 2 was substantially similarly repeated except that somewhat flat iron particles having an average b/a of 0.57 and an average c/a of 0.52 were used as the magnetic particles 5, whereby good results were similarly obtained.

COMPARATIVE EXAMPLE 1

Example 4 was similarly repeated except that iron particles with a shape of thin and flat plate having an average b/a of 0.55 and an average c/a of 0.22 were used as the magnetic particles 5, whereby circulation of the magnetic particles became poor to result in partial decrease in image density.

COMPARATIVE EXAMPLE 2

Copying test was conducted similarly as in Example 4 except that bar-shaped magnetic particles having an average b/a of 0.2 and an average c/a of 0.15 were used as the magnetic particles 5, whereby circulation of the magnetic particles became poor to result in partial decrease in image density.

While nonmagnetic toners were used in the foregoing examples, magnetic toners can also be used as far as their magnetism is substantially weaker than that of the magnetic particles and they are triboelectrically chargeable.

What is claimed is:

1. A method for applying a toner comprising:

forming, in a container containing a toner and magnetic particles for application of the toner, a magnetic brush of the magnetic particles;

circulating the magnetic particles in the container; and forming a thin layer of the toner electrically charged on the toner carrying member, wherein the magnetic particles have such shape characteristics that, where each magnetic particle is assumed to be circumscribed with the rectangular parallelepiped having edge lengths of a, b and c satisfying $a \geqq b \geqq c$ with the proviso that all of a, b and c are not the same, the average of b/a is from 0.4 to 1.0 and the average of c/a is from 0.4 to 0.95.

2. The method for applying a toner according to claim 1, wherein the average of b/a is from 0.5 to 1.0 and the average of c/a is from 0.5 to 0.9.

3. The method for applying a toner according to claim 1, wherein the magnetic particles comprise 50 wt. % or more of particles having sizes of 50 to 200 microns.

4. The method for applying a toner according to claim 3, wherein the magnetic particles comprise 70 wt. % or more of particles having sizes of 50 to 200 microns.

5. The method for applying a toner according to claim 1, wherein the weight ratio of the toner to the magnetic particles in a magnetic brush forming region where said magnetic brush is formed is from 5:95 to 50:50.

6. The method for applying a toner according to claim 5, wherein the weight ratio of the toner to the magnetic particles in the magnetic brush forming region is from 7:93 to 15:85.

7. The method for applying a toner according to claim 1, wherein the magnetic particles comprise surface-oxidized or non-oxidized particles of a metal selected from the group consisting of iron, nickel, cobalt, manganese, chromium, rare earth metals and alloys of these, or particles of an oxide of these metals.

8. The method for applying a toner according to claim 1, wherein the toner is chromatically colored and free of a magnetic material.

9. The method for applying a toner according to claim 1, wherein the toner has a volume average particle size of 5 to 20 microns.

* * * * *